US005107571A

United States Patent [19]

Marzoli et al.

[11] Patent Number: 5,107,571

[45] Date of Patent: Apr. 28, 1992

[54] PRECARDING CYLINDERS AND ADJUSTABLE KNIFE AND CARDING UNITS

[75] Inventors: Pietro B. Marzoli, Bergamo; Aldo Urgnani, Palazzolo, both of Italy

[73] Assignee: Fratelli Marzoli & C. S.p.A., Italy

[21] Appl. No.: 588,907

[22] Filed: Sep. 27, 1990

[30] Foreign Application Priority Data

Sep. 27, 1989 [IT] Italy ..... 21843 A/89

[51] Int. Cl.[5] ..... D01G 15/20; D01G 15/34; D01G 15/24

[52] U.S. Cl. ..... 19/105; 19/107

[58] Field of Search ..... 19/95, 98, 99, 100, 19/104, 105, 107, 110, 113, 200, 202, 204, 205

[56] References Cited

U.S. PATENT DOCUMENTS

| | | | |
|---|---|---|---|
| 620,089 | 2/1899 | Threlfall | 19/105 |
| 1,409,627 | 3/1922 | Wehli | 19/105 |
| 1,910,662 | 5/1933 | Willis | 19/95 X |
| 2,600,969 | 6/1952 | Clapperton | 19/105 |
| 3,457,595 | 7/1969 | Schulze | 19/204 X |
| 4,135,275 | 1/1979 | Gunter et al. | 19/107 |
| 4,355,439 | 10/1982 | Estebanell | 19/105 |
| 4,472,859 | 9/1984 | Elliott et al. | 19/105 |
| 4,505,005 | 3/1985 | Staehli | 19/95 X |
| 4,524,492 | 6/1985 | Elliott | 19/95 X |
| 4,539,728 | 9/1985 | Portell | 19/105 |
| 4,805,268 | 2/1989 | Leifeld | 19/107 X |
| 4,815,170 | 3/1989 | Portell | 19/105 |
| 4,969,235 | 11/1990 | Mark | 19/105 |

FOREIGN PATENT DOCUMENTS

| | | | |
|---|---|---|---|
| 0203513 | 7/1967 | U.S.S.R. | 19/105 |
| 0715655 | 2/1980 | U.S.S.R. | 19/108 |
| 0000849 | of 1912 | United Kingdom | 19/105 |
| 0257235 | 6/1927 | United Kingdom | 19/95 |
| 0832803 | 4/1960 | United Kingdom | 19/105 |
| 2057522 | 4/1981 | United Kingdom | 19/105 |
| 2206610 | 1/1989 | United Kingdom | 19/105 |

*Primary Examiner*—Werner H. Schroeder
*Assistant Examiner*—Ismael Izaguirre
*Attorney, Agent, or Firm*—Diller, Ramik & Wight

[57] ABSTRACT

In a carding apparatus for fibrous material, of the type in which the staple fibres are fed by a feed roller to an introduction roller of a carding machine and are subjected to preliminary opening and impurity removal, at least one carding unit is provided along the path between the introduction cylinder and the carding cylinder. The carding unit comprises a removal knife at its inlet, a guide blade for the fibres at its exit, and a carding surface extending therebetween. The carding unit is position-adjustable in directions circumferential and radial to the introduction cylinder. The knife and blade can be adjusted independently in a prevalently radial direction to the introduction cylinder. Preferably two individually adjustable carding units are provided. Between the carding unit or units and the carding cylinder there is provided a mixing and homogenizing carding cylinder.

20 Claims, 1 Drawing Sheet

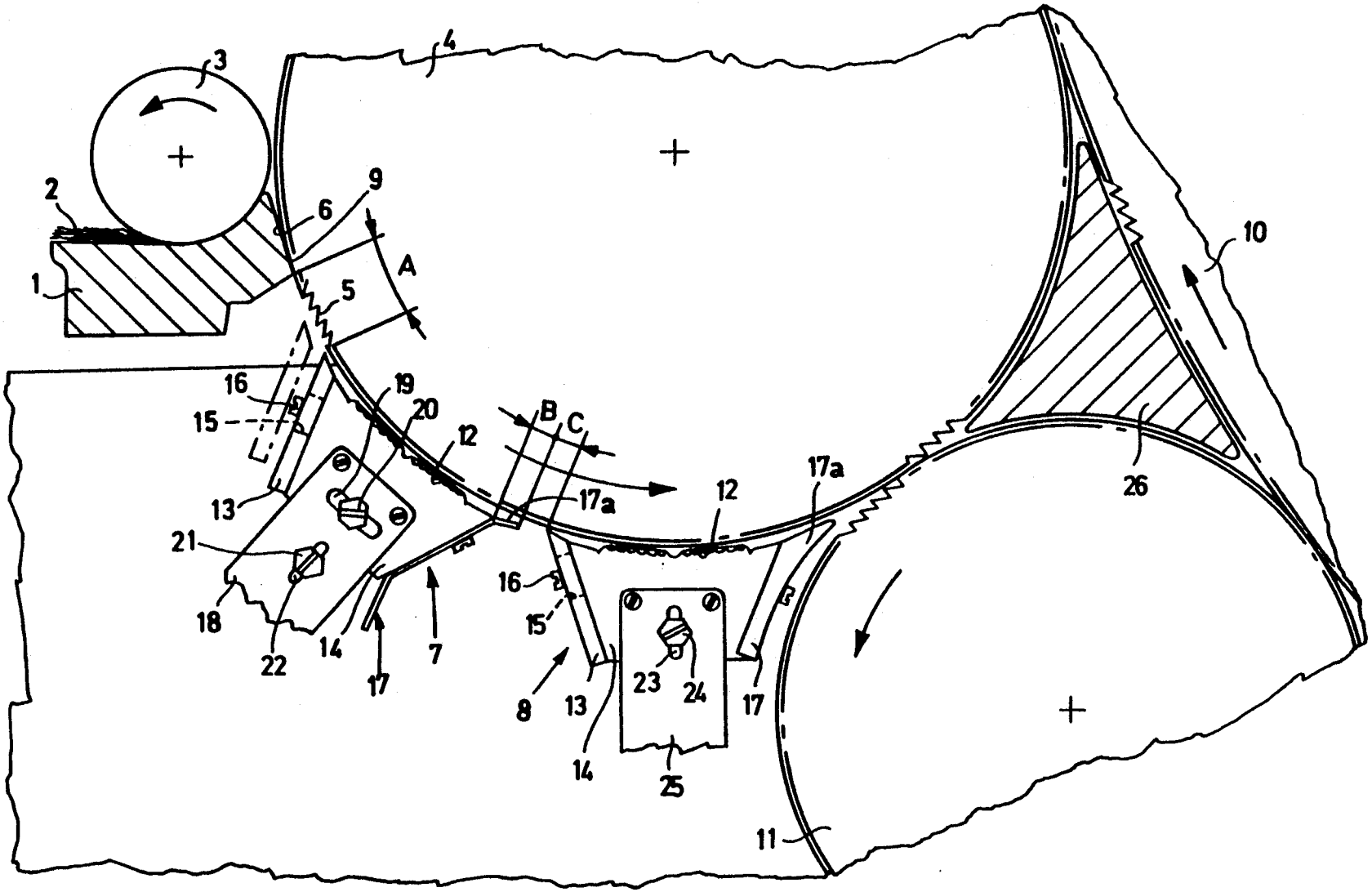
1
2
3
4
5
6
7
8
9
10
11
12
13
14
15
16
17
17a
18
19
20
21
22
23
24
25
26
A
B
C

PRECARDING CYLINDERS AND ADJUSTABLE KNIFE AND CARDING UNITS

BACKGROUND OF THE INVENTION

This invention relates to a carding apparatus for textile materials, and more particularly to an apparatus of the type in which the staple fibres are fed along a feed table to a feed roller of a carding machine and are subjected to preliminary opening and impurity removal action along the path between an introduction cylinder and a carding cylinder of the carding machine.

Apparatus of this type is known in the art, its main purpose being to prepare the material for the actual carding action. It is precisely in the effectiveness of their fibre cleaning action and preliminary opening action that such known apparatus displays certain deficiencies, which often lead to unsatisfactory results in the preliminary carding action obtained by the carding machine.

In this respect, insufficient preliminary opening of the fibres, for example of cotton, is sometimes noted between the feed table and the carding cylinder, and/or excessive residual impurities and hard tufts in the material reaching the carding cylinder, these being impurities and hard tufts which have not been removed during the path upstream of the carding cylinder.

A further problem which can occur is excessive fibre wear by the cylinder card clothing.

SUMMARY OF THE INVENTION

An object of the present invention is to overcome these limitations and drawbacks by providing an apparatus of the initially specified type which improves the fibre preliminary opening action along the path between the introduction cylinder and the carding cylinder and also allows effective removal of impurities and hard tufts along the same path, so providing the carding cylinder with a cleaner and more homogeneous material, thus improving the quality of the silver obtained at the machine exit.

A further object of the invention is to provide an apparatus of the aforesaid type which allows regulation of the quantity and quality of the trash and impurities to be removed, so increasing the efficiency of the removal knife cleaning.

A further object of the invention is to provide an apparatus in which thinner card clothing can be used, resulting in less wear of the fibres being worked and an improvement in the quality of the sliver leaving the machine.

These objects are attained according to the invention by a carding apparatus for textile materials of the initially specified type, characterised in that in that portion of the fibre path between the introduction cylinder and the carding cylinder there is disposed at least one carding unit provided with a removal knife and a guide blade for the fibres, the unit being position-adjustable circumferentially and radially to the introduction cylinder, between said at least one carding unit and the carding cylinder there being disposed a mixing and homogenizing carding cylinder which cooperates in the discordant direction with the introduction cylinder and in the concordant direction with the carding cylinder.

Advantageously, means can be provided for independently adjusting the position of the unit support and of the knife and/or blade on the support.

BRIEF DESCRIPTION OF THE DRAWING

The single FIGURE of drawing is a fragmentary cross-sectional view through the apparatus of the invention, and illustrates an introduction cylinder, a main carding cylinder, and a mixing and homogenizing carding cylinder between the introduction and main carding cylinders, and a pair of carding units between the introduction and mixing and homogenizing carding cylinders.

DESCRIPTION OF THE PREFERRED EMBODIMENT

On the drawing, the reference numeral 1 indicates a feed table for staple fibres 2 collected in the form of a blanket of generally rectangular cross-section, the fibres being advanced by a feed roller 3 in known manner.

An introduction cylinder 4, rotating at the feed point in a direction discordant to the direction of rotation of the feed cylinder 3, as indicated by the arrows, licks-in the fibres 2 by means of the clothing 5 with which it is provided.

The staple fibres, pinched between the introduction cylinder 4 and the facing surface 6 of the feed table 1, are conveyed towards at least one guide blade unit 7 (or 8) located a certain distance from the point 9 of pinching between the cylinder 4 and table 1, along the fibre path between the introduction cylinder 4 and a main carding cylinder 10. Two carding units 7 and 8 are provided in the illustrated example.

Between the carding unit or units 7, 8 and the main carding cylinder 10 there is disposed a mixing and homogenizing carding cylinder 11 cooperating in the discordant direction with the introduction cylinder 4 and in the concordant direction with the main carding cylinder 10. The cylinders 10 and 11 are provided with respective card clothing, not shown in detail as it is well known.

Each carding unit 7, 8 is provided with a carding surface 12 facing the introduction cylinder 4 and provided with adequate clothing or with protuberances shaped to provide carding action.

Upstream of the carding surface 12 each carding unit 7, 8 possesses a removal knife 13 arranged on the unit support 14 preferably position-adjustable in a direction prevalently radial to the introduction cylinder 4. For this purpose the knife 13 can comprise relative slots 15 extending in the adjusting direction and arranged to receive fixing screws 16 screwed into the support 14.

Downstream of the carding surface 12 each carding unit 7, 8 comprises a guide blade 17 having a guide surface **17*a* approaching the introduction cylinder 4 and of length such as to determine the quantity and quality of the fibres and non-fibrous material to remove. The blade 17 is also preferably position-adjustable in a direction prevalently radial to the introduction cylinder 4, for example by a system such as that used for the removal knife 13**.

Advantageously, as can be seen on the drawing, the removal knife 13 and the guide blade 17 of the carding units 7 and 8 are disposed in such a manner that they can be position-adjusted in directions which converge at a point external to the introduction cylinder.

According to one characteristic of the invention, at least the carding unit 7 is position-adjustable in a direction circumferential and radial to the introduction cylinder 4. For this purpose, as illustrated, the support 14 can be fixed to support arms 18 comprising a slot 19 extending concentrically to the cylinder 4 and through which there penetrates a fixing screw 20 which is screwed into the support 14. The support arm 18 can be position-adjusted radially to the cylinder 4 by a like system comprising a screw 21 and a slot 22 extending radially to the cylinder 4, the screw 21 being screwed into a fixed element, not shown, of the machine structure.

The carding unit 8 can also be position-adjusted radially to the cylinder 4 on a fixed support arm 25 by means of the slot 23 and screw 24 as illustrated. The unit 8 could also be position-adjustable in a direction circumferential to the cylinder 4, as the unit 7.

The two carding units 7 and 8 are preferably disposed such that the circumferential distance A between the point of introduction 9 of the fibres and the removal knife 13 of the first carding unit 7 is greater than the circumferential distance C between the point of exit of the fibres from the first carding unit 7 and the point of action of the removal knife 13 of the second carding unit 8.

As can be seen from the drawing, between the introduction cylinder 4, main carding cylinder 10 and mixing and homogenizing carding cylinder 11 there is inserted a fibre guide wedge 26.

In operation, the fibres conveyed by the introduction cylinder 4 undergo a preliminary opening and an initial cleaning action by the removal knife 13 of the unit 7. During this stage the quantity and quality of the impurities to be removed depends on the length A, which can be advantageously adjusted to obtain optimum conditions for the type of fibre treated.

Along the carding surface 12 of the unit 7 the fibrous material is arranged into a parallel flow, to then reach the adjustable guide blade 17 where the fibres are guided onto the removal knife 13 of the unit 8. The quantity and quality of fibres and impurities to be removed depends here on the length B, i.e., substantially on the length of the portion 17*a* of the radially adjustable blade 17 of the unit 7, and on the length C. By virtue of the described adjustments the various elements can be positioned to obtain optimum clean-up conditions for the type of fibre treated.

The fibres then undergo in the carding unit 8 the same treatment undergone in the carding unit 7, so improving the effectiveness of the cleaning and parallel-arranging action and the fibre homogenization.

At their exit from the unit 8 the fibres conveyed by the introduction cylinder 4 encounter the mixing and homogenizing carding cylinder 11 which takes up the excess fibre quantity, which is then transferred to the carding cylinder 10 at the point of cooperation between the cylinder 11 and the cylinder 10.

From the aforegoing description it is apparent that by making the carding units adjustable it is possible to improve the quality of the fibres fed to the carding cylinder 10 by more effectively removing impurities and hard tufts and performing a perfect preliminary opening action, by which the total carding intensity of the machine and the quality of the sliver obtained at its exit are substantially improved.

It is also possible to use thinner card clothing, with resultant less wear of the fibres being worked.

The described invention can undergo various modifications while remaining within the inventive concept. For example, more than two carding units could be provided. The two carding units could be position-adjusted circumferentially together instead of individually unit by unit. Again, it is not essential for the removal knives 13 and/or the guide blades 17 of all the carding units to be adjustable individually on their respective supports 14.

We claim:

1. A carding apparatus for textile materials comprising an introduction cylinder, a mixing and homogenizing carding cylinder and a main carding cylinder; each of said cylinders being rotatable in a predetermined direction of rotation, each of said cylinders having a peripheral surface along which fibres are fed along a path of travel beginning at a fibre introduction point at said introduction cylinder peripheral surface and continuing downstream to a medial point between the peripheral surfaces of said introduction and mixing and homogenizing carding cylinders toward a downstream point between said introduction and main carding cylinders, said introduction cylinder peripheral surface being in intimate adjacent relationship to the peripheral surfaces of said mixing and homogenizing carding and main carding cylinders at said respective medial and downstream points, the directions of rotation of said introduction and mixing and homogenizing carding cylinders being the same which effects discordant direction therebetween, the directions of rotation of said main carding and mixing and homogenizing carding cylinders being different which effects concordant direction therebetween, at least one carding unit provided with a removal knife and a guide blade, said at least one carding unit being disposed along said path adjacent said introduction cylinder between said introduction and medial points, and means for effecting at least one of circumferential and radial position adjustment of said at least one carding unit relative to said introduction cylinder.

2. The carding apparatus as defined in claim 1 wherein said mixing and homogenizing carding and main carding cylinders peripheral surfaces are in intimate adjacent relationship with each other.

3. The carding apparatus as defined in claim 2 including a fibre guide wedge disposed between said cylinders, and said fibre guide wedge includes a guide surface disposed in adjacent cooperative relationship with each peripheral surface.

4. The carding apparatus as defined in claim 1 including a fibre guide wedge disposed between said cylinders, and said fibre guide wedge includes a guide surface disposed in adjacent cooperative relationship with each peripheral surface.

5. The carding apparatus as defined in claim 1 wherein said adjustment effecting means effects both circumferential and radial position adjustment of said at least one carding unit relative to said introduction cylinder.

6. The carding apparatus as defined in claim 5 including a fibre guide wedge disposed between said cylinders, and said fibre guide wedge includes a guide surface disposed in adjacent cooperative relationship with each peripheral surface.

7. The carding apparatus as defined in claim 5 including at least one additional carding unit provided with a removable knife and a guide blade, said at least one additional carding unit being disposed along said path adjacent said introduction cylinder between said introduction and medial points, and additional means for effecting at least one of circumferential and radial position adjustment of said at least one additional carding unit relative to said introduction chamber.

8. The carding apparatus as defined in claim 5 including at least one additional carding unit provided with a removable knife and a guide blade, said at least one additional carding unit being disposed along said path adjacent said introduction cylinder between said introduction and medial points, and additional means for effecting circumferential and radial position adjustment of said at least one additional carding unit relative to said introduction chamber.

9. The carding apparatus as defined in claim 5 including at least one additional carding unit provided with a removable knife and a guide blade, said at least one additional carding unit being disposed along said path adjacent said introduction cylinder between said introduction and medial points, and said adjustment effecting means is effective to simultaneously effect the position adjustment of both said at least one and said at least one additional carding units.

10. The carding apparatus as defined in claim 5 including means for adjusting the position of said knife relative to said at least one carding unit in a direction generally radially relative to said introduction cylinder.

11. The carding apparatus as defined in claim 5 including means for adjusting the position of said guide blade relative to said at least one carding unit in a direction generally radially relative to said introduction cylinder.

12. The carding apparatus as defined in claim 5 wherein said removable knife and guide blade are disposed in generally relative divergent relationship to the peripheral surface of said introduction cylinder.

13. The carding apparatus as defined in claim 1 including at least one additional carding unit provided with a removable knife and a guide blade, said at least one additional carding unit being disposed along said path adjacent said introduction cylinder between said introduction and medial points, and additional means for effecting at least one of circumferential and radial position adjustment of said at least one additional carding unit relative to said introduction cylinder.

14. The carding apparatus as defined in claim 13 wherein said at least one carding unit is spaced upstream along said path relative to said at least one additional carding unit, and the circumferential distance between said fibre introduction point and the removal knife of said at least one carding unit is greater than the circumferential distance along said path between a point of exit of the fibres from the at least one carding unit and the removal knife of said at least one additional carding unit.

15. The carding apparatus as defined in claim 1 including at least one additional carding unit provided with a removable knife and a guide blade, said at least one additional carding unit being disposed along said path adjacent said introduction cylinder between said introduction and medial points, and additional means for effecting circumferential and radial position adjustment of said at least one additional carding unit relative to said introduction cylinder.

16. The carding apparatus as defined in claim 1 including at least one additional carding unit provided with a removable knife and a guide blade, said at least one additional carding unit being disposed along said path adjacent said introduction cylinder between said introduction and medial points, and said adjustment effecting means is effective to simultaneously effect the position adjustment of both said at least one and said at least one additional carding units.

17. The carding apparatus as defined in claim 1 including means for adjusting the position of said knife relative to said at least one carding unit in a direction generally radially relative to said introduction cylinder.

18. The carding apparatus as defined in claim 1 including means for adjusting the position of said guide blade relative to said at least one carding unit in a direction generally radially relative to said introduction cylinder.

19. The carding apparatus as defined in claim 1 including means for adjusting the position of said knife relative to said at least one carding unit in a direction generally radially relative to said introduction cylinder, and means for adjusting the position of said guide blade relative to said at least one carding unit in a direction generally radially relative to said introduction cylinder.

20. The carding apparatus as defined in claim 1 wherein said removable knife and guide blade are disposed in generally relative divergent relationship to the peripheral surface of said introduction cylinder.

* * * * *